United States Patent [19]

Terpay

[11] 3,957,104

[45] May 18, 1976

[54] METHOD OF MAKING AN APERTURED CASTING

[75] Inventor: Andrew Terpay, Middleburg Heights, Ohio

[73] Assignee: The United States of America as represented by the Administrator of the United States National Aeronautics and Space Administration, Washington, D.C.

[22] Filed: Feb. 27, 1974

[21] Appl. No.: 446,568

[52] U.S. Cl. ..... 164/132
[51] Int. Cl.[2] ..... B22D 29/00
[58] Field of Search ..... 164/132, 34

[56] References Cited

UNITED STATES PATENTS

| | | | |
|---|---|---|---|
| 2,362,875 | 11/1944 | Zahn | 164/132 |
| 2,679,669 | 6/1954 | Kempe | 164/132 X |
| 2,687,278 | 8/1954 | Smith et al. | 164/132 X |
| 3,401,738 | 9/1968 | Parille | 164/399 X |
| 3,422,880 | 1/1969 | Brown et al. | 164/34 X |
| 3,596,703 | 8/1971 | Bishop et al. | 164/132 |

*Primary Examiner*—Francis S. Husar
*Assistant Examiner*—John E. Roethel
*Attorney, Agent, or Firm*—N. T. Musial; J. A. Mackin; J. R. Manning

[57] ABSTRACT

An apertured casting is made by first forming a duplicate in the shape of the finished casting, positioning refractory metal bodies such as wires in the duplicate at points corresponding to apertures or passageways in finished products, forming a ceramic coating on the duplicate, removing the duplicate material, firing the ceramic in a vacuum or inert atmosphere, vacuum casting the metal in the ceramic form, removing the ceramic form, heating the cast object in an atmospheric furnace to oxidize the refractory metal bodies and then leaching the oxidized refractory bodies from the casting with a molten caustic agent or acid solution.

12 Claims, 2 Drawing Figures

METHOD OF MAKING AN APERTURED CASTING

ORIGIN OF THE INVENTION

This invention was made by an employee of the United States Government and may be made or used by or for the Government of the United States without the payment of any royalties thereon or therefor.

BACKGROUND OF THE INVENTION

This invention relates to the casting art and is directed more particularly to a method of casting the metal body having more and more apertures therein.

A particular example of the type of casting with which the invention is concerned is a gas turbine blade of the air-cooled type. Such blades are usually hollow and include hundreds of cooling apertures.

The apertures in the hollow turbine blade may be made by a number of methods which include mechanical drilling, electrical disintegrating drilling or by casting the blade with metal wires in place. In the latter method the wires are removed by heating the casting in an atmospheric furnace at a temperature high enough to cause the wires to be removed by sublimation. The first two methods are obviously time-consuming and very expensive. Thus, in the latter method, the use for a period of time of an expensive item of equipment, namely the furnace, is required to carry out the sublimation.

OBJECTS AND SUMMARY OF THE INVENTION

It is an object of the invention to provide a new and improved method for casting metal bodies, particularly of high temperature nickel-chrome alloys, having a plurality of apertures therein.

It is another object of the invention to provide a method for making an apertured body by the investment casting and lost wax process with a substantial reduction of time over prior art methods.

Still another object of the invention is to provide a method for making an apertured casting wherein the use of expensive equipment is minimized, thereby reducing costs.

Yet another object of the invention is to provide an improved casting method for apertured bodies wherein the apertures are located in inaccessible areas.

In summary, the invention improves upon the investment casting and lost wax process by casting the metal over prepositioned wires or bodies selected from a metal whose oxides may be leached out with a caustic or acid material.

DESCRIPTION OF A PREFERRED EMBODIMENT OF THE INVENTION

Figure 1:
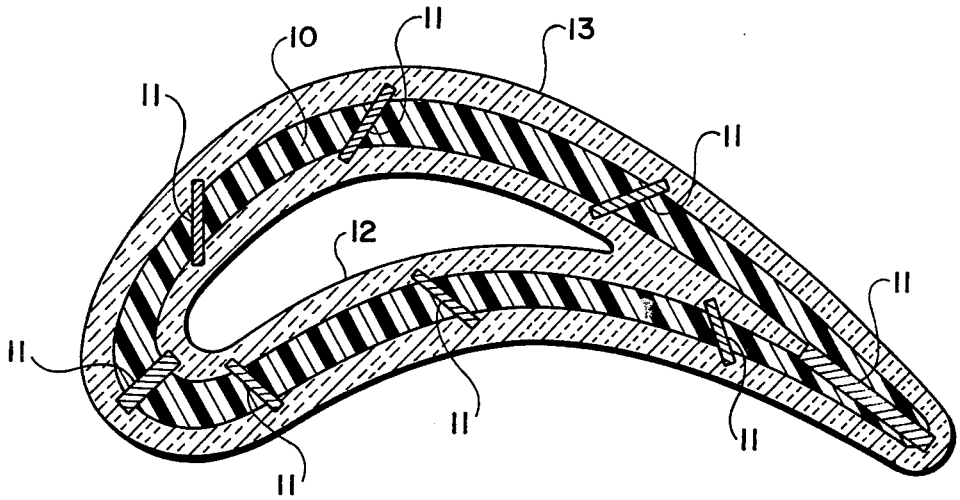
FIG. 1 is a cross-sectional view of a duplicate of the body to be cast with its ceramic coating in pins positioned at locations of desired apertures.

Referring now to FIG. 1, there is shown at 10 a duplicate of the desired final casting. The material of the duplicate 10 is preferably wax but may be any material which may be dissolved or melted without damaging or melting refractory metal wires or pins 11 which are inserted into the duplicate in coincidence with positions at which there are to be passageways or apertures in the final casting. The pins 11 are of a metal which will oxidize well below the melting temperature of the material from which the casting is to be made. To insure against any alloying of pins 11 with the casting metal, an oxide such as alumina oxide may be coated on the pins by various well-known techniques prior to insertion of the pins into the duplicate. However, as will be explained subsequently, an oxide coating advantageously forms on the pins 11 during one of the early steps of the method embodying the invention. Examples of such metals include molybdenum, tungsten and tantalum with tungsten being preferred since it oxidizes more easily. The pins 11 extend out of the surfaces of duplicate 10 by at least 0.03 inch.

Both the interior and exterior of the duplicate are coated with a ceramic slurry which is then hardened by drying to form mold members 12 and 13. The duplicate is then removed by melting, as in the case of a wax, or by otherwise dissolving. If the duplicate material is to be melted out, the temperature must be substantially below the oxidation temperature of the particular metal of pins 11.

The ceramic mold is then fired in a vacuum furnace at 50 microns or less pressure or in a furnace containing an inert gas or hydrogen until the ceramic is fully cured. The hydrogen or inert gas is maintained at a pressure of about 2 ounces per square inch. The time and temperature will depend upon the ceramic material used and these particular parameters are generally well known with regard to the curing of ceramic materials.

During the ceramic curing step an oxide layer has been found to form on the pins 11, as indicated previously, and advantageously prevents alloying of the pins 11 with the casting metal. This oxide is believed to form because, whether the ceramic is cured in a vacuum, an inert gas atmosphere or a hydrogen atmosphere, some oxygen contamination is present.

Figure 2:
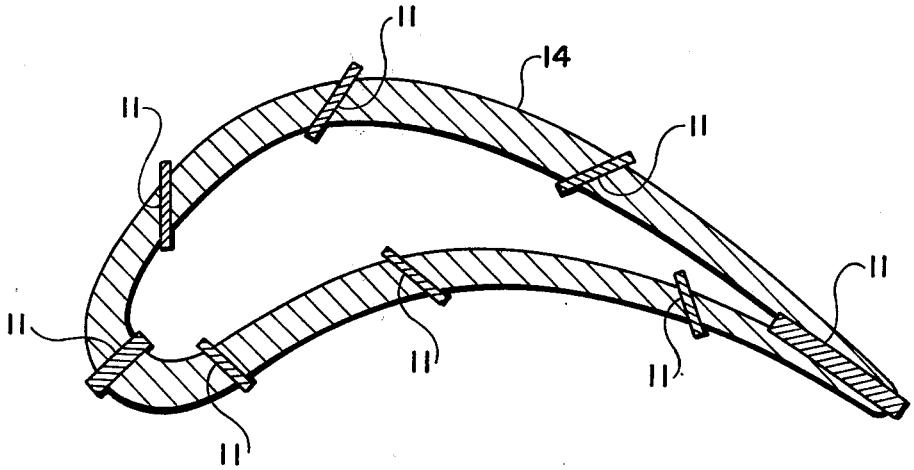
FIG. 2 is a cross-sectional view of a cast turbine blade with the aperture pins in place.

The metal to be used for the casting is heated to molten temperature and ladled into the ceramic mold, preferably using well-known vacuum casting techniques. After the metal solidifies, the ceramic mold is removed. The casting metal is any metal which has a substantially higher melting temperature than that in the oxidation temperature of the refractory aperture pins or wires and is preferably a high temperature nickel-chrome alloy such as IN-100. The casting is shown at 14 in FIG. 2 with the aperture pins 11 in place and after the removal of the ceramic mold.

To remove the pins 11 and thereby provide apertures in the casting 14, the casting is disposed in an oxidizing furnace and heated in an oxidizing atmosphere at a temperature great enough to oxidize the pins 11 but not great enough to melt or damage the casting itself. This temperature is preferably on the order of 2000° F but may be anywhere in the range from about 1000° F to 2000° F.

After pins 11 are completely oxidized, they are then leached out by subjecting the cast body, as for example by immersion, to a molten caustic salt such as $Na_2CO_3$, $K_2CO_3$, NaFl, CaFl or NaOH at a temperature of from about 1000° F to about 1500° F with 1300° F being a preferred temperature. Where pins 11 are W or Mo, NaFl and CaFl are the preferred caustic salts. However, for Mo pins, an acid solution of 35% nitric acid and water may be used for leaching. Where the pins 11 are tantalum, the leaching can be accomplished with a solution comprised of 20% hydrofluoric acid and 40% nitric acid, the remainder being water.

The time required to leach out the pins 11 is dependent on their length and diameter, as well as their location and the contour of the surrounding metal. In general, the leaching must be continued until the oxidized pins 11 are completely removed.

It will be understood that those skilled in the art to which the invention pertains may change or modify the invention without departing from the spirit and scope of the invention, as set forth in the claims appended hereto.

What is claimed is:

1. A method of making a cast object of the type having perforations or passages therein comprising the steps of:

forming a duplicate of the object to be cast from a material having a relatively low melting point;

inserting wires in said object duplicate corresponding to the desired location of apertures in said object, said wires being selected from a metal which oxidizes when subjected to a temperature from about 1000° to 2000°;

forming a ceramic coating on said duplicate object;

removing said material;

firing said ceramic in a substantially nonoxidizing atmosphere to produce a mold and to form an oxide coating on said wires;

casting a metal in said ceramic mold;

removing said ceramic mold;

heating said cast object to a temperature range of from about 1000° F to 2000° in an oxidizing atmosphere to oxidize said wires; and leaching out the oxidized wires with an agent which corrodes and dissolves the oxidized wires without reacting significantly with the casting metal at a temperature of from about 1000° F to 1500° F, the melting point of said material being lower than the oxidation temperature of said wires.

2. The method of claim 1 wherein said wires are selected from the group of metals consisting of molybdenum, tantalum and tungsten.

3. The method of claim 1 wherein the leaching agent is a molten caustic salt selected from the group consisting of $Na_2CO_3$, $K_2CO_3$, NaFl, CaFl and NaOH.

4. The method of claim 1 wherein the agent is an acid comprising at least 35% nitric acid, the remainder being water.

5. The method of claim 4 wherein some of the water is replaced by 20% hydrofluoric acid.

6. The method of claim 1 wherein said wires are positioned to extend at least 0.030 inch out of the surface of said duplicate object.

7. The method of claim 1 wherein said casting metal is one selected from the group consisting of high temperature-chrome nickel alloys.

8. The method of claim 1 wherein said wires range from about 0.003 inch to about 0.125 inch in diameter.

9. The method of claim 1 wherein said wires are tungsten and said agent is NaFl.

10. The method of claim 1 wherein said wires are tantalum and said agent is a mixture comprising 40% nitric acid and 20% hydrofluoric acid, the remainder being water.

11. The method of claim 1 wherein the ceramic firing step is carried out in a vacuum of less than about 50 microns pressure.

12. The method of claim 1 wherein the ceramic firing step is carried out in a hydrogen atmosphere of about 2 ounces per square inch pressure.

* * * * *